US006798388B2

(12) United States Patent
Mayer et al.

(10) Patent No.: US 6,798,388 B2
(45) Date of Patent: Sep. 28, 2004

(54) STUBBY, MULTI-BAND, ANTENNA HAVING A LARGE-DIAMETER HIGH FREQUENCY RADIATING/RECEIVING ELEMENT SURROUNDING A SMALL-DIAMETER LOW FREQUENCY RADIATING/RECEIVING ELEMENT

(75) Inventors: Cheryl Ann Mayer, Lincoln, NE (US); Yingdong Song, Lincoln, NE (US); Shawn Michael Carraher, Lincoln, NE (US); Brian Todd Potter, Lincoln, NE (US)

(73) Assignee: Centurion Wireless Technologies, Inc., Lincoln, NE (US)

( * ) Notice: Subject to any disclaimer, the term of this patent is extended or adjusted under 35 U.S.C. 154(b) by 0 days.

(21) Appl. No.: 10/329,209

(22) Filed: Dec. 23, 2002

(65) Prior Publication Data

US 2004/0119657 A1 Jun. 24, 2004

(51) Int. Cl.[7] ..... H01Q 1/36
(52) U.S. Cl. ..... 343/895; 343/702
(58) Field of Search ..... 343/702, 895, 343/900, 901

(56) References Cited

U.S. PATENT DOCUMENTS 6,297,784 B1 * 10/2001 Chang ..... 343/895
6,338,812 B1 * 1/2002 Ogura ..... 264/254
6,340,955 B1 * 1/2002 Chao ..... 343/895

* cited by examiner

*Primary Examiner*—James Vannucci
(74) *Attorney, Agent, or Firm*—Holland & Hart

(57) ABSTRACT

An antenna is responsive to both a low frequency band and a high frequency band. The antenna includes a metal connector and a hollow insulating tube that is supported by the metal connector. A relatively large diameter metal coil that is responsive to the low frequency band is coiled about an outer surface of the insulating tube, and one end of this coil is connected to the metal connector. A relatively small diameter metal coil that is responsive to the high frequency band is coiled adjacent to an inner surface of the insulating tube, and one end of this coil is connected to the metal connector. A metal disk is mounted on and electrically connected to an opposite end of the small diameter coil. A sheath of dielectric material axially compresses the two coils against the metal connector and also provides an outer cover for the antenna.

24 Claims, 7 Drawing Sheets

STUBBY, MULTI-BAND, ANTENNA HAVING A LARGE-DIAMETER HIGH FREQUENCY RADIATING/RECEIVING ELEMENT SURROUNDING A SMALL-DIAMETER LOW FREQUENCY RADIATING/RECEIVING ELEMENT

FIELD OF THE INVENTION

This invention relates to the field of radio wave communication, and more specifically to radio wave antennas that have multiple resonant frequencies and are utilized, for example, in a wireless communications system.

BACKGROUND OF THE INVENTION

Antennas having more than one radiating/receiving element (hereinafter radiating element) are known.

U.S. Pat. No. 5,771,023 (incorporated herein by reference) describes an antenna wherein a first helical antenna is carried by a hollow insulating sleeve, and wherein an insulating assembly that includes a straight-wire antenna and a second helical antenna may be moved to either an extended or a retracted position within the insulating sleeve. When this antenna is in an extended position, the straight-wire antenna is located above the insulating sleeve, and the straight-wire antenna forms a main antenna function. When this antenna is in a retracted position, the straight-wire antenna is essentially inactive, and the two helical antenna are active.

U.S. Pat. No. 6,249,257 (incorporated herein by reference) provides a switched, dual-band, retractable antenna having a hollow and stationary assembly that includes an inner and an outer helical radiator, and having an elongated monofilar radiator that is movable within this hollow assembly. When the monofilar radiator is extended, the monofilar radiator is connected to an associated telephone, as the two helical radiators are disconnected from the telephone. When the monofilar radiator is retracted, the two helical radiators are connected to the telephone, as the monofilar radiator is disconnected from the telephone.

U.S. Pat. No. 4,772,895 (incorporated herein by reference) provides an antenna wherein a first relatively long helical resonator has one end connected to a feed conductor, this same end of the first helical resonator being surrounded by a relatively short dielectric spacer. A second relatively short helical resonator surrounds the dielectric space, and a corresponding end of this second helical resonator is connected to ground. The dielectric spaced is constructed such that the grounded second helical resonator is tightly capacitive coupled or inductive coupled to the first helical resonator.

U.S. Pat. No. 6,300,913 (incorporated herein by reference) provides an antenna wherein a first flat or non-wire helical resonator is carried on the outside of a hollow housing, and wherein a second flat or non-wire helical resonator is carried by a member that is inserted into the hollow housing.

U.S. Pat. No. 6,127,979 (incorporated herein by reference) provides an assembly having a straight-wire whip antenna that is located within a helical antenna, wherein the whip antenna and the helical antenna are coupled to a single feedpoint, wherein a single matching network provides matching for both the whip antenna and the helix antenna, and wherein the antenna assembly can be reduced in size by attaching a disk to a top of the whip antenna.

Other examples of non-telescoping or stubby antennas for use within wireless communication devices such as cellular telephones include U.S. Pat. No. 6,133,885 and 6,275,198 (incorporated herein by reference.

SUMMARY OF THE INVENTION

This invention provides a non-telescoping antenna, also known as a stubby antenna. A non-limiting example of the utility of an antenna in accordance with the invention is for use as the transmitting/receiving antenna of a multi-band wireless communication device.

More specifically, the present invention provides a small-profile (about 10 to about 15 mm long) stubby antenna having (1) a relatively large diameter element, consisting of a metal element or a meander pattern wire that forms the antenna's low-frequency-band radiating element, and (2) a centrally-located and smaller diameter coiled or bent metal wire whose top end is electrically connected to a metal disk that is located at the top of the stubby antenna, this small diameter coiled/bent wire and its disk forming the antenna's high-frequency-band radiating element.

While the axis of this small diameter coiled or bent wire extends perpendicular to the plane of the metal disk, this construction and arrangement is not to be taken as a limitation on the spirit and scope of the invention.

In non-limiting embodiments of the invention the bottom ends of the two wire coils were mechanically supported by, and electrically connected to, a metal snap-in connector or a metal screw-in connector that was located at the base of the antenna, this construction and arrangement being adapted for use in mechanically and electrically coupling the antenna to a wireless communication device.

In non-limiting embodiments of the invention the two above-mentioned wire coils were formed of a silver-plated beryllium copper wire having a diameter of about 0.41 mm.

Within the spirit and scope of this invention, the above-described small diameter center wire coil can be formed by the three-dimensional series-connection of a number of spiral wire portions, or by the three-dimensional series-connection or the two-dimensional series-connection (i.e. in-plane connection) of a number of semicircular wire portions, or by the three-dimensional series-connection or by the two-dimensional series-connection of a number of triangular or zig-zag wire portions.

It is also within the spirit and scope of this invention to form the antenna's top located metal disk, the antenna's small diameter coiled or bent wire coil, and the antenna's bottom-located connector as a single structural element.

It is also within the spirit and scope of this invention to form the large diameter coil element from a meander pattern, such as a flexible and metallized dielectric film, a stamped metal sheet, or a metal plated plastic.

The presence of the above-described coils or bends in the antenna's small diameter center wire provides additional physical length to this center wire, thus providing better high band performance, while minimizing the physical length of the antenna. The antenna's toplocated metal disk provides a specific absorption rate (SAR) improvement by moving the high current point of the antenna further away from head of a person using a cellular telephone that includes the antenna of the present invention.

Antennas in accordance with the invention include an exterior cup-shaped sheath that is formed of a dielectric material, for example a synthetic thermoplastic resin such as polycarbonate. This sheath either snaps onto, screws onto, or is adhesive-attached onto a similar plastic member that is associated with and supports the above-mentioned bottom-located metal connector. This exterior sheath can also be molded directly onto the metal snap-on or screw-in connector that is located at the base of the antenna.

Within the spirit and scope of this invention the antenna's bottom-located plastic base and metal connector may included a snap-in coupling for physically and electrically mounting the antenna to an associated wireless communication device, or a screw-in coupling for physically and electrically mounting the antenna to an associated wireless communication device.

BRIEF DESCRIPTION OF THE DRAWINGS

FIGS. 9, 10 and 11 show three embodiments of the antenna's relatively small diameter and centrally-located coil of wire wherein FIG. 9 shows the above-described embodiment, wherein FIG. 10 shows an in-plane small diameter coil that is composed of series-connected semicircles of wire, and wherein FIG. 11 shows an in-plane coil that is composed of series-connected triangular or zig-zag portions of wire

DETAILED DESCRIPTION OF THE INVENTION

Figure 1:
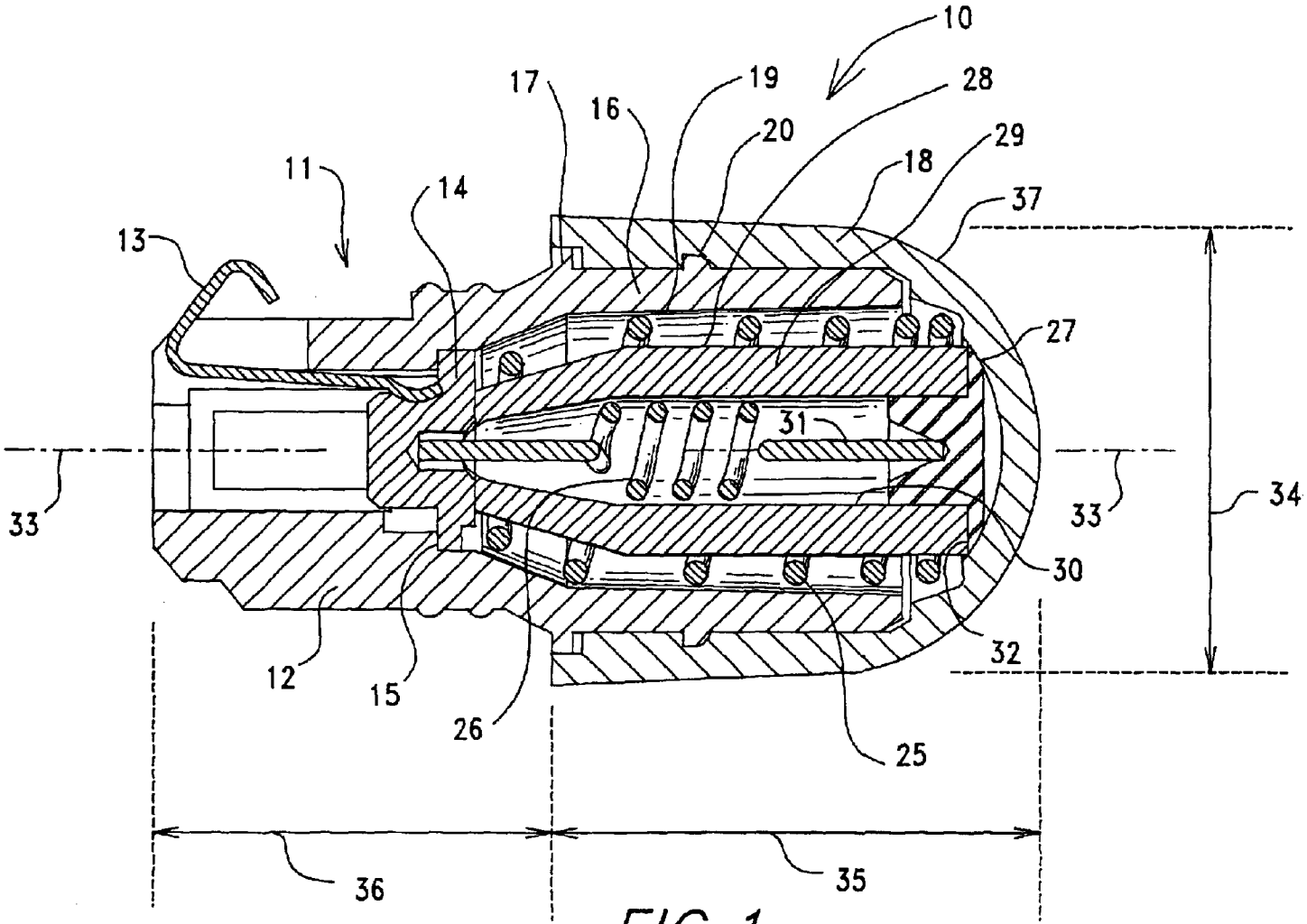
FIG. 1 is an enlarged section view of a snap-in base stubby antenna in accordance with the present invention wherein the section is taken along the antenna's central axis.

FIG. 1 is an enlarged center-line section view of a small snap-in base stubby antenna 10 in accordance with the present invention, antenna 10 having a snap-in base 11 that includes a dielectric-material tubular member 12 and a resilient metal spring-clip 13 that is provided for connection to the internal circuitry of a wireless communications device such as a cellular telephone (not shown). Antenna 10 is generally symmetrical about its center axis 33, with the exception of its snap-in base whereat metal clip 13 is located.

Figure 12:
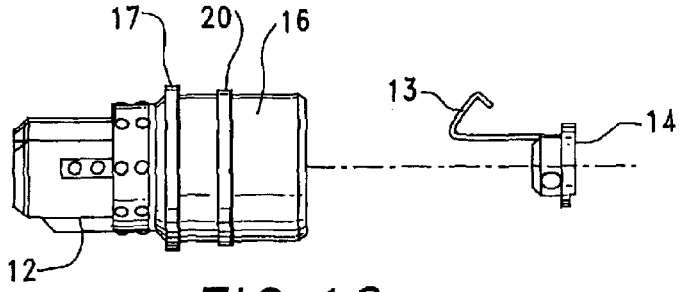
FIG. 12 is an exploded view that shows how the FIG. 1 metal spring-clip connector that is located on the antenna's snap-in base connects to the antenna's internal and bottom-located metal connector.

Metal clip 13 is electrically mounted on and mechanically connected to a metal connector 14 that is centered on axis 33 and is located inside of antenna 10 in a manner to be supported by an annular shoulder 15 that is formed in tubular member 12. This electrical connection of clip 13 to the antenna's internal metal connector 14 is best seen in FIG. 12.

The upper cylindrical portion 16 of tubular member 12 includes an annular shoulder 17 upon which the antenna's dielectric-material outer sheath 18 is mounted, for example by way of a snap-fit between an annular recess 19 that is internally carried by sheath 18 and an annular ridge 20 that is externally carried by the cylindrical portion 16 of tubular member 12. In other embodiments of the invention, sheath 18 may be molded in place on antenna 10.

Antenna 10 is a multi-band antenna. For example antenna 10 is responsive to a low-resonance of from about 880 to about 960 MHz, and to a high-frequency-resonance of from about 1710 to about 2170 MHz. With changes in the wire-length of the antenna's two coiled radiating elements, antenna 10 responds to the AMPS, GPS, and Bluetooth frequency bands. In addition, since the 1710–2170 frequency band covers the DCS, PCS and UMTS frequency bands, antenna 10 can be considered to be a quad-band antenna, even though antenna 10 provides dual resonance.

The antenna's low-frequency-band radiating element comprises a relatively large diameter coil 25 of metal wire having an axis that is generally coincident with axis 33.

The antenna's high-frequency-band radiating element comprises a relatively small diameter coil 26 of metal wire having an axis that is generally coincident with axis 33, and whose upper end 31 is electrically connected to a top-located metal disk 27 that is generally centered on axis 33, wherein the plane of disk 27 extends generally perpendicular to axis 33.

Antenna 10 includes an internally-located, hollow, dielectric-material spacer tube 29 whose axis is generally coincident with axis 33. The generally-cylindrical and outer surface 28 of spacer tube 29 supports large diameter wire coil 25, the generally-cylindrical inner surface 30 of spacer tube 29 supports small diameter wire coil 26, and the top annular surface 32 of spacer tube 29 lies in a plane that extends generally perpendicular to axis 33 and physically supports metal disk 27.

As will be apparent, in the FIG. 1 embodiment of the invention one end of each of the two metal coils 25 and 26 is electrically connected to metal connector 14, and the operation of physically mounting sheath 18 onto antenna 10 (see FIG. 8) operates to axially compress metal coil 25, and to axially compress metal coil 26 with its metal disk 27 on one end thereof, into the two coil-positions that are shown in FIG. 1.

Without limitation thereto, coils 25 and 26 can be formed of a silver-plated beryllium copper wire, and the number of turns within outer coil 25 may vary, as the number of turns within inner coil 26 may vary. More generally, the number of turns on a coil can vary when tuning an antenna to a different frequency(s) than GSM/DCS/PCS/UMTS.

In an embodiment of the invention dimension 34 of FIG. 1 was about 9.5 millimeter (mm), dimension 35 was about 10.5 mm, dimension 36 was about 8.5 mm, and the dome-shaped top-surface 37 of sheath 18 was formed on a radius of about 4.75 mm.

Figure 2:
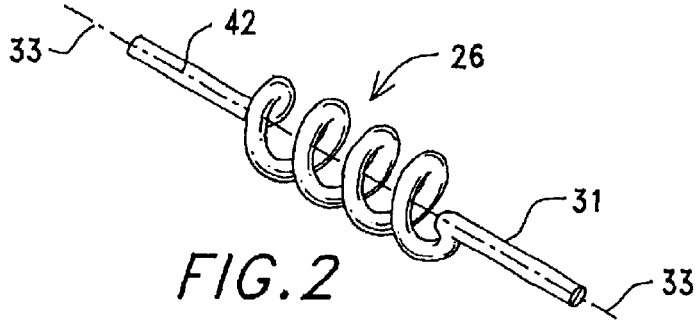
FIG. 2 is a perspective view of the center-located and small diameter coil of metal wire of the FIG. 1 antenna.
Figure 3:
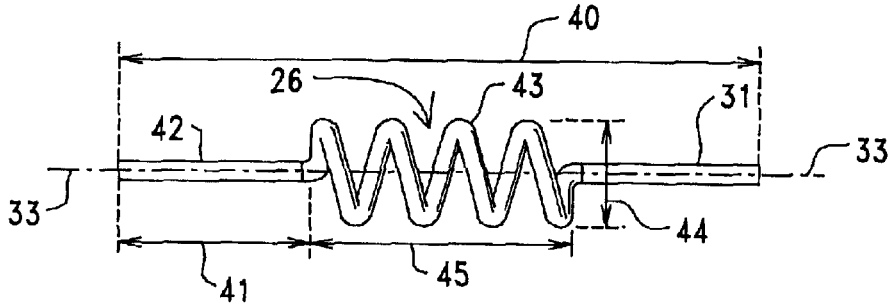
FIG. 3 is a side view of the FIG. 2 center-located coil of wire.

FIG. 2 is a perspective view of the small diameter coil of metal wire 26 that is centered within antenna 10, and FIG. 3 is a side view of wire coil 26.

In a non-limiting embodiment of the invention the overall, not-compressed, axial length 40 of wire coil 26 was about 12.5 mm. The end 31 of wire coil 26 that both physically and electrically engages disk 27 was about 3.69 mm in axial length, this being generally the same as the axial length 41 of the end 42 of wire coil 26 that both physically and electrically engages connector 14.

The generally mid-portion of wire coil 26 comprised a multi-turn coil 43 whose coilturns have an outer diameter 44 of about 2.04 mm. In this embodiment of the invention the not-compressed axial length 45 of the coil's mid-portion was about 5.11 mm, and the multiturn coil 43 had a coil-pitch of about 1.343 turns per mm.

Figure 4:
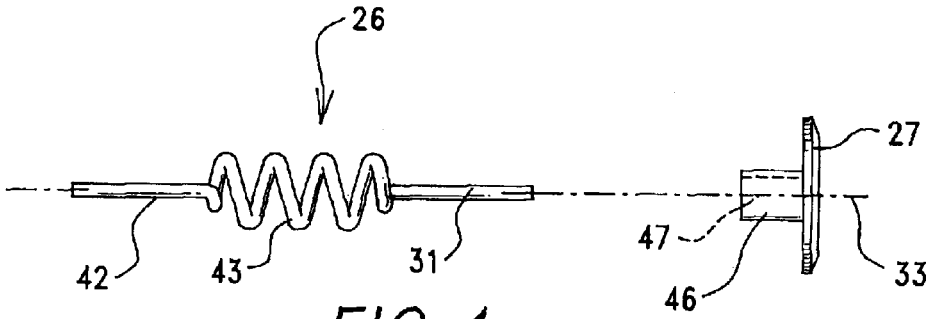
FIG. 4 shows the antenna's small diameter and centrally-located coil of wire prior to mounting one end thereof onto the antenna's top-located metal disk.

FIG. 4 shows the antenna's relatively small diameter coil of wire 26 prior to mounting the antenna's top-located metal disk 27 onto the end 31 of wire coil 26. In order to facilitate this mechanical and electrical joining of disk 27 to the end 31 of wire coil 26, the underside of disk 27 is provided with a metal boss 46 that contains a mounting hole 47 whose axis is coincident with antenna axis 33, mounting hole 47 being dimensioned to slideably receive the end 31 of wire coil 26. A metal disk 27 having this geometric shape is sometimes called a top-hat disk.

Figure 5:
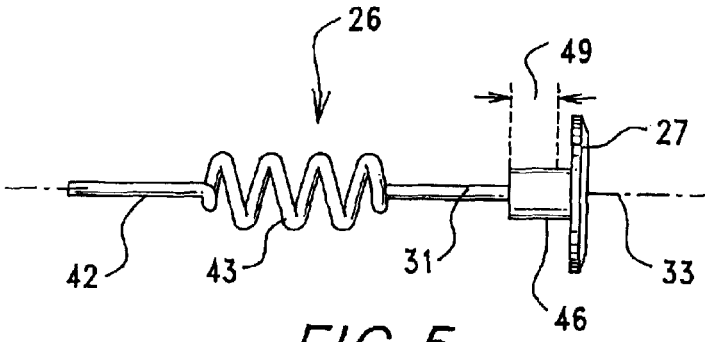
FIG. 5 is a view similar to FIG. 4 wherein the antenna's top-located metal disk wire has been attached to one end of the antenna's small diameter and centrally-located coil of wire, or wherein the top-located metal disk is physically held against this one end of the centrally-located coil of wire by a force that is applied to the metal disk so as to axially compress the coil of wire.

FIG. 5 is a view similar to FIG. 4 wherein metal boss 46 has been crimped within a crimp-zone 49 so as to physically mount disk 27 onto the end 31 of wire coil 26. In other embodiments of the invention disk 27 is held in place by axial compression of wire coil 26.

Figure 6:
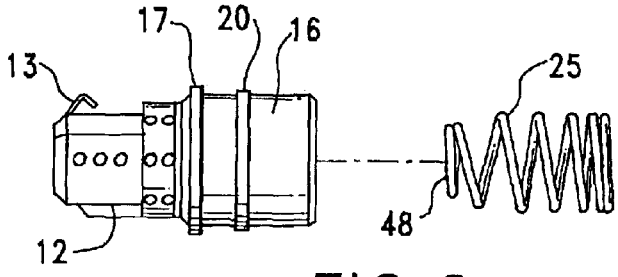
FIG. 6 is an exploded view of a portion of the FIG. 1 antenna wherein the antenna's relatively large diameter coil of wire that forms the antenna's low-frequency-band radiating element is shown in a position prior to insertion into the antenna's base member.
Figure 7:
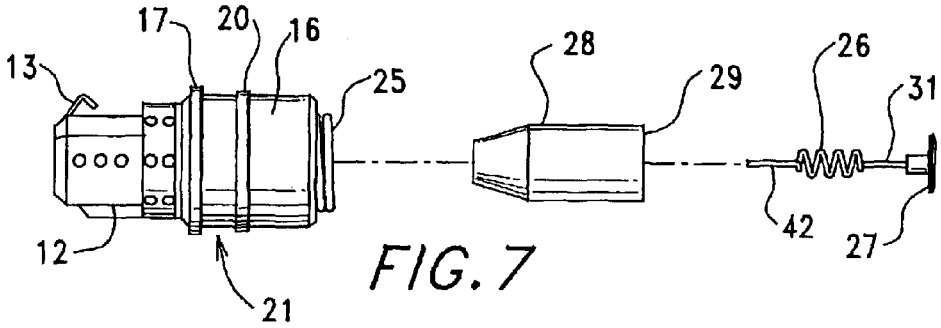
FIG. 7 is an exploded view similar to FIG. 6 that shows the antenna's relatively large diameter coil of wire inserted into the antenna's base member, that additionally shows an insulating spacer tube in a position prior to insertion into the relatively large diameter coil of wire, and that additionally shows the antenna's relatively small diameter centrally-located coil of wire and disk in position prior to insertion into the spacer tube.
Figure 8:
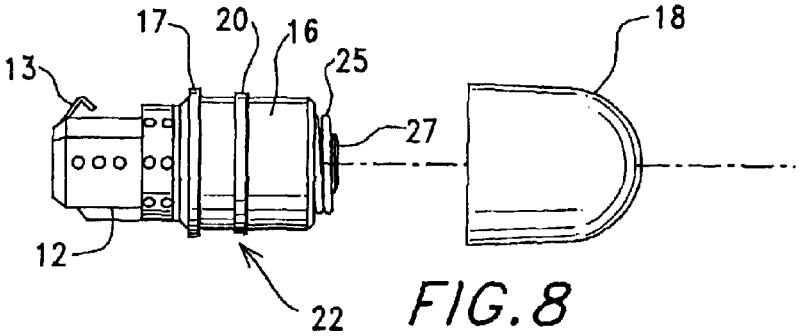
FIG. 8 is an exploded view similar to FIG. 7 that shows the antenna's relatively large diameter coil of wire inserted into the antenna's base member, that shows the antenna's spacer tube insertion into the relatively large diameter coil of wire, that shows the antenna's relatively small diameter centrally-located coil of wire and disk inserted into the spacer tube, and that additionally shows the antenna's exterior dielectric sheath in a position prior to mounting unto into the antenna's base member so as to axially compress both the relatively large diameter coil of wire and the relatively small diameter centrally-located coil of wire.

FIGS. 6, 7 and 8 show a series of steps in a process of assembling antenna 10, to thereby produce the antenna that is shown in FIG. 1.

FIG. 6 is an exploded view of a portion of antenna 10 wherein the antenna's relatively large diameter coil of wire 25 that forms the antenna's low-frequency-band radiating element is shown in a position prior to insertion into the upper tubular portion 16 of the antenna's dielectric-material tubular member 12. Once large diameter wire coil 25 has been so inserted, electrical connection is made between the smaller-diameter end 48 of coil 25 and metal connector 14, as shown in FIG. 1. The result is the subassembly 21 that is shown in FIG. 7.

FIG. 7 is an exploded view similar to FIG. 6 that shows the antenna's relatively large diameter coil of wire 25 in an operative (but not-compressed) position within the antenna's tubular member 16. FIG. 7 additionally shows the antenna's hollow and dielectric-material spacer tube 29 in a position prior to insertion into the relatively large diameter wire coil 25 that now resides within tubular member 16. FIG. 7 additionally shows the antenna's relatively small diameter coil of wire 26, and its FIG. 5 disk 27, in position prior to insertion of this coil/disk assembly 26/27 into hollow spacer tube 29. Once spacer tube 29 and coil/disk assembly 26/27 have been so inserted into tubular member 16, the end 42 of wire coil 26 is electrically connected to metal connector 14, as shown in FIG. 1. The result is the subassembly 22 that is shown in FIG. 8.

FIG. 8 is an exploded view similar to FIG. 7 that shows the antenna's relatively large diameter wire coil 25 inserted into the antenna's tubular member 16, that shows the antenna's hollow spacer tube 29 insertion into the relatively large diameter wire coil 25, that shows the antenna's coil/disk assembly 26/27 inserted into hollow spacer tube 29, and that additionally shows the antenna's dielectric-material sheath 18 in a position prior to mounting sheath 18 onto the antenna. When sheath 18 is so mounted, as shown in FIG. 1, both relatively large diameter wire coil 25 and relatively small diameter wire coil 26 are axially compressed to the position that is shown in FIG. 1. Within the spirit and scope of the invention sheath 18 may be molded onto antenna 10, to thereby form antenna 10 and sheath 18 as a single unitary assembly.

It will be noted that in the above description, the top turn of outer wire coil 25 (i.e. the wire-turn that is opposite connector 14) comprises an open-turn in that the wire-end of coil 25 does not physically engage the wire that forms coil 25. However, within the spirit and scope of this invention this top turn can be a closed-turn wherein the wire-end of coil 25 physically engages a portion of the wire the forms the top turn of wire coil 25.

Figure 9:
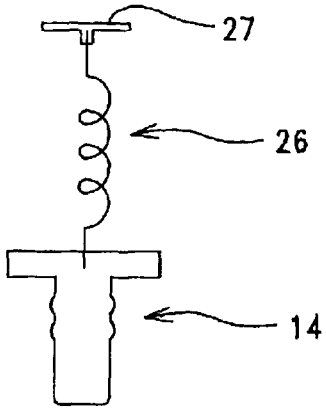

In the above description small diameter coil 26 has been shown as a being formed by a series of three-dimensional turns of wire that connect to form a unitary coil 26, as is shown in FIG. 9. However, within the spirit and scope of the invention other wire-forms can be provided to accomplish the result of providing a relatively long metal wire coil that extends between metal disk 27 and metal connector 14.

Figure 10:
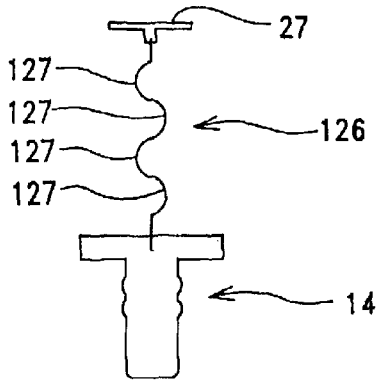
Figure 11:
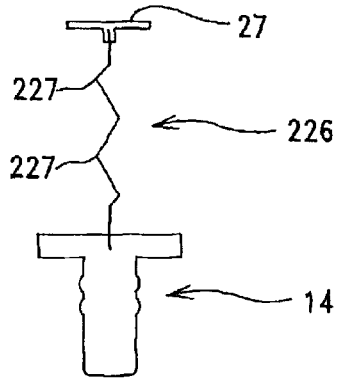

FIGS. 10 and 11 show non-limiting examples of other wire-forms that can be used in accordance with the invention.

In FIG. 10 the antenna's relatively small diameter and centrally-located wire coil 126 is shown to be an in-plane wire-form that comprises the series-connection of four semicircles 127 of wire that occupy a common plane. However, it is to be noted that wire semicircles 127 can occupy individually different planes, to thus provide a three-dimensional wire coil 126.

In FIG. 11 the antenna's relatively small diameter and centrally-located wire coil 226 is shown to be an in-plane wire-form that comprises the series-connection of two triangular or zig-zag wire portions 227 of wire that occupy a common plane. Here again, wire portions 227 can individually occupy different planes, to thus provide a three-dimensional wire coil 226.

FIGS. 13 through 20 show an embodiment of the invention wherein a small, molded, stubby antenna 55 in accordance with the invention includes a bottom-located metal screw-in connector 56 having a pattern of external screw threads 65 that enable antenna 55 to be screwed into and mounted on a wireless communications device, such as a cellular telephone (not shown), so as to electrically connect the antenna's connector 56 to circuitry that resides within the wireless communications device With reference to these figures, antenna 55 is generally symmetrical about its central axis 57, antenna 55 includes a relatively large diameter coil 58 of metal wire that is responsive to a low-resonance of from about 880 to about 960 MHz, and antenna 55 includes a relatively small diameter coil 59 of metal wire that is electrically connected to a top-located metal top-hat disk 60 and is responsive to a high-resonance of from about 1710 to about 2170 MHz.

In this embodiment of the invention, relatively large diameter coil 58 is supported by a spiral groove 61 (see FIG. 16) whose axis is coincident with axis 57 and is formed in the outer cylindrical surface 62 of a hollow and insulating dielectric-material coilform member 63 whose axis is coincident with axis 57.

Figure 13:
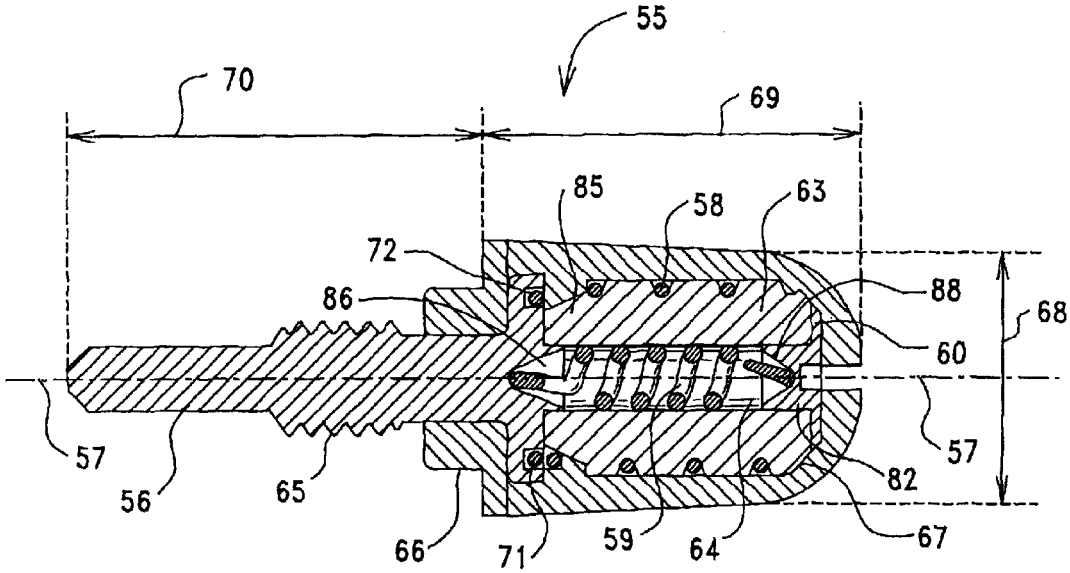
FIG. 13 is a center-line section view of a screw-in base stubby antenna in accordance with the present invention.

As is best seen in FIG. 13, dielectric-material coilform member 63 includes a centrally located cylindrical bore 64 whose axis is coincident with antenna axis 57 and operates to support a relatively small diameter metal coil 59 such that the axis of coil 59 is also coincident with axis 57.

Figure 20:
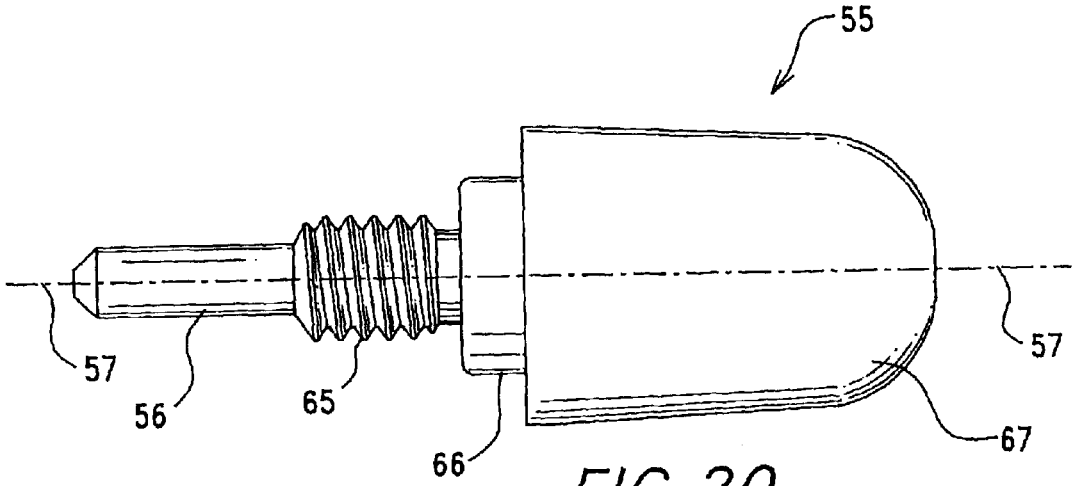
FIG. 20 is a view similar to FIG. 19 that shows the antenna of FIG. 13 with its outer dielectric sheath secured or molded in place.

As best seen in FIGS. 13 and 20, the exterior surface of antenna 55, that is the surface of antenna 55 that is exterior to a wireless communications device, is formed by an insulating dielectric-material base member 66 and a dielectric-material sheath 67. With reference to FIG. 13, in an embodiment of the invention dimension 68 of antenna 55 was about 8.89 mm, dimension 69 was about 13.25 mm, and dimension 70 was about 14.42 mm.

Figure 14:
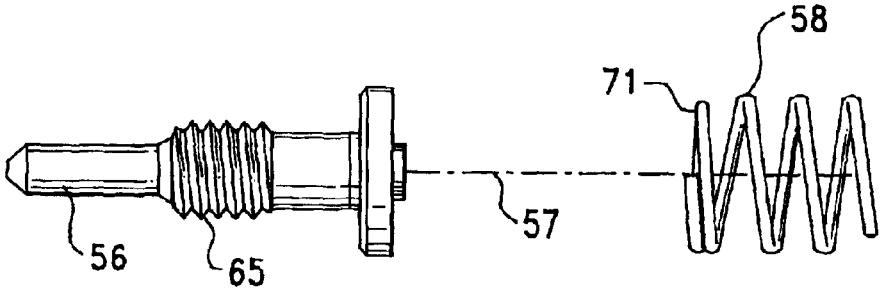
FIG. 14 is an exploded view of a portion of the FIG. 13 antenna wherein the antenna's large diameter coil of wire that forms the antenna's low-frequency-band radiating element is shown in a position prior to insertion onto the antenna's bottom-located metal connector.
Figure 15:
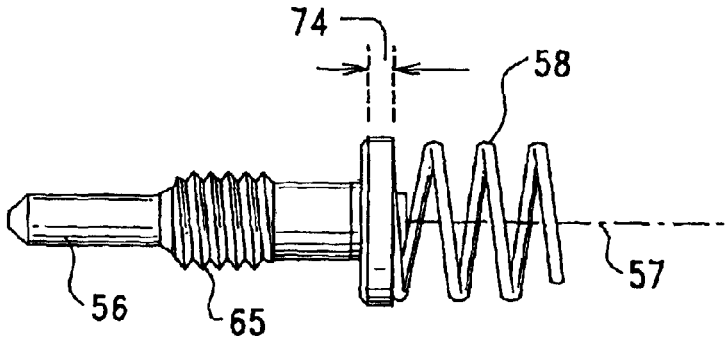
FIG. 15 is a view similar to FIG. 14 wherein the antenna's large diameter coil of wire has been attached to the antenna's bottom-located connector.

FIGS. 14 and 15 show a process for mounting the end 71 of large diameter wire coil 58 within an annular groove 72 (best seen in FIG. 13) that is formed in metal connector 56 so as to be concentric with axis 57. In FIG. 15 the antenna's low-resonance radiating coil 58 has been physically attached to, and electrically connected to, the antenna's bottom-located connector 56 by crimping an annular groove 72 that is formed within connector 56, this crimping action taking place within FIG. 15's crimp-zone 74. In this position of large diameter coil 58, the axis of coil 58 is located coincident with the axis 57 of antenna 55.

Figure 16:
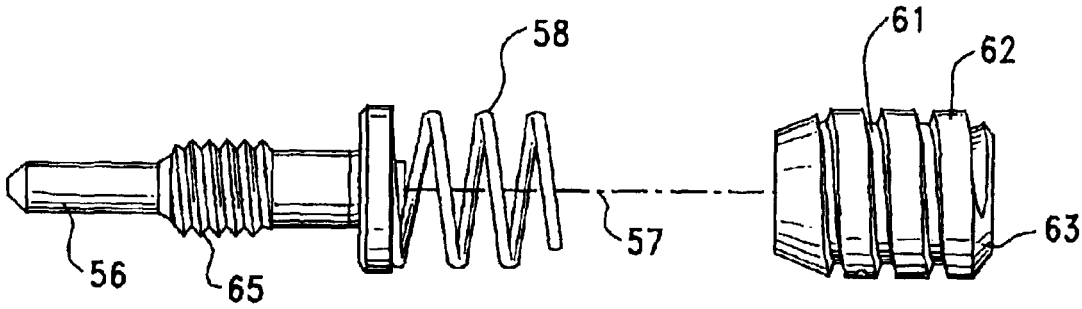
FIG. 16 is a view similar to FIG. 15 wherein the antenna's large diameter coil of wire crimped or pressure-held to the antenna's bottom-located metal connector, and additionally shows the antenna's insulating coilform member in a position prior to insertion onto the antenna's large diameter coil of wire.
Figure 17:
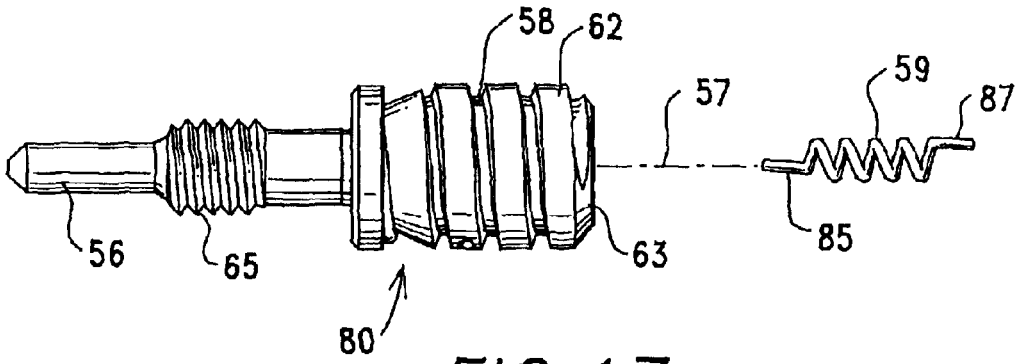
FIG. 17 is a view similar to FIG. 16 wherein the antenna's large diameter coil of wire and coilform member attached to the antenna's bottom-located metal connector, and additionally shows the antenna's small diameter and centrally-located coil of wire in position prior to insertion into the coilform.

FIGS. 16 and 17 show how coilform member 63 is threaded into large diameter coil 58 to thereby form the subassembly 80 that is shown in FIG. 17 wherein the antenna's relatively small diameter metal coil 59 is shown ready for insertion into the cylindrical bore 64 that is formed within coilform member 63.

Figure 18:
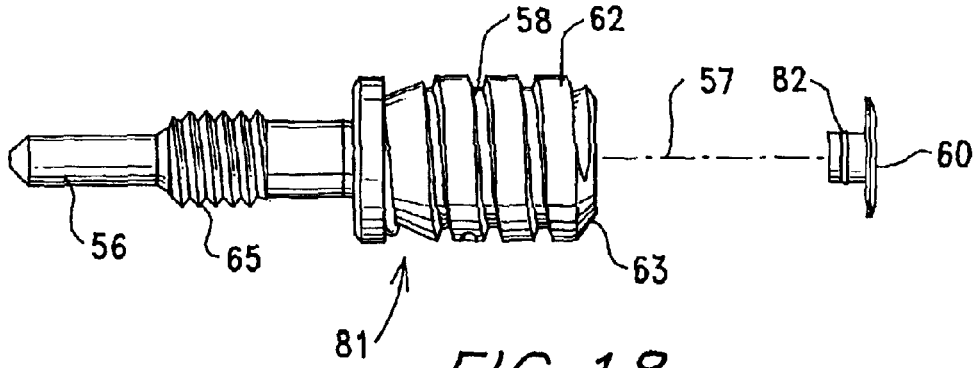
FIG. 18 is a view similar to FIG. 17 wherein the antenna's large diameter coil of wire, the antenna's coilform member, and the antenna's small diameter and centrally-located coil of wire mounted on the bottom-located connector, and additionally shows the antenna's toplocated metal disk in position to be mounted onto, or pressure-held against, an end of the antenna's small diameter and centrally-located coil of wire.
Figure 19:
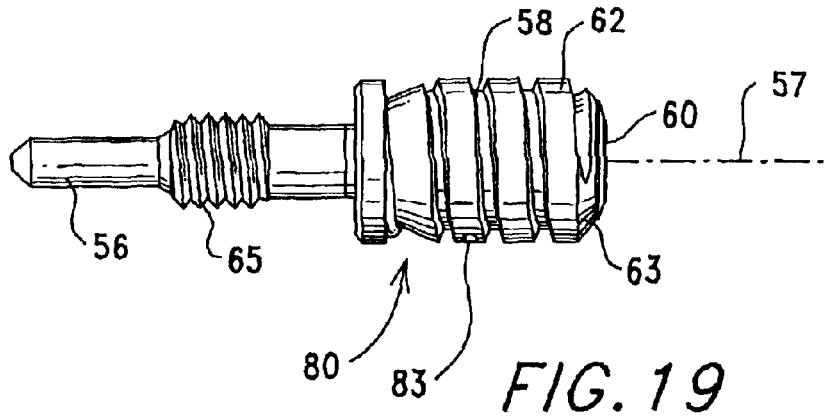
FIG. 19 is a view similar to FIG. 18 that shows the antenna of FIG. 13, minus its outer dielectric sheath.

When the FIG. 17 operation has been completed the subassembly 81 of FIG. 18 is ready to receive the antenna's top-located metal disk 60 and its protruding boss 82, thus producing the subassembly 83 that is shown in FIG. 19.

As can be best seen in FIG. 13, one end 85 of small diameter metal coil 59 now sits within a cone-shaped hole 86 that is formed in metal connector 56, and the other end 87 of metal coil 59 now sits within a cone-shaped hole 88 that is formed in the boss 82 that is carried by metal disk 60.

In the assembly operation of FIG. 18 to produce the subassembly 83 of FIG. 19, small diameter metal coil 59 is also axially compressed between metal connector 56 and metal disk 60, as above described relative to FIG. 1. Again, within the spirit and scope of the invention small diameter metal coil 59 may take other coil forms as was above-described with reference to FIGS. 10 and 11.

As a final step in the process of producing the FIG. 13 antenna 55, a dielectricmaterial sheath 67 and a dielectric-material base member 66 are secured to metal connector 56, for example by a molding step, to thereby form antenna 55 as shown in FIG. 20. Within the spirit and scope of the invention, sheath 67 may be snapped, screwed or glued onto base member 66 to form antenna 55.

Figure 21:
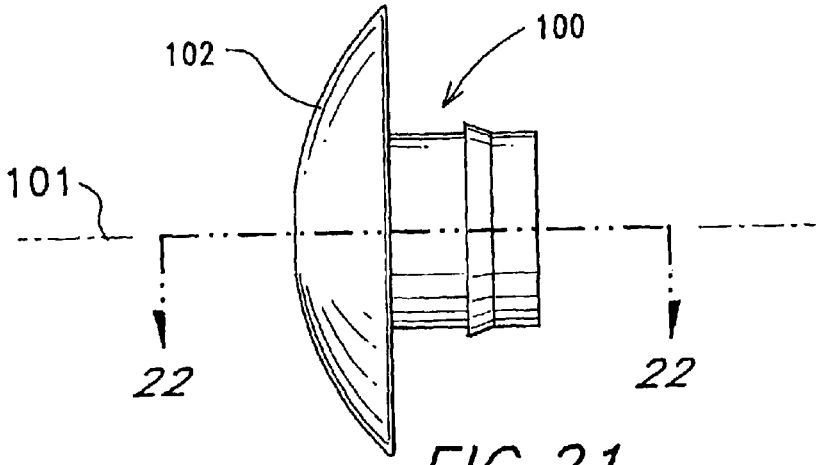
FIG. 21 shows a side view of another type of metal disk that may be substituted for the metal disk shown in FIG. 4.
Figure 22:
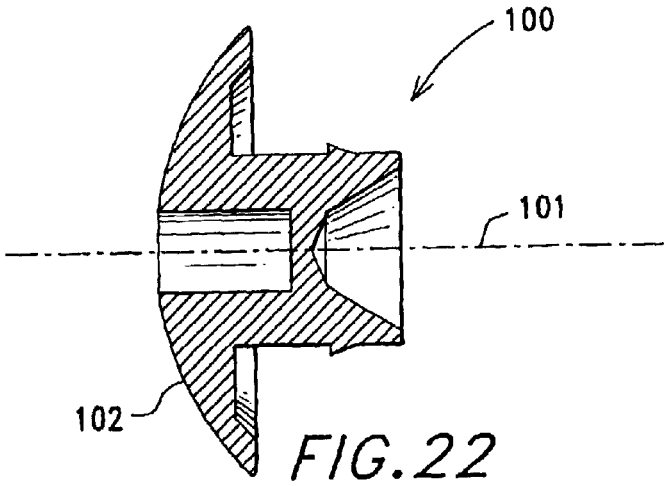
FIG. 22 is a center-axis section view of the metal disk of FIG. 21.

FIG. 21 is a side view of another type of metal disk 100 that may be substituted for the metal disk 27 that is shown in FIG. 4, and FIG. 22 is a section view of metal disk 100 that is taken on its central axis 101.

Disk 100 differs from disk 27 in that the top surface 102 of disk 100 is dome-shaped, rather than flat as is provided in disk 27. It has been found that the dome-shaped top surface 102 of disk 100 tends to provide better performance as the axial length of center coil 26 increases.

In addition, a top-located metal disk 27 or 100 in accordance with the spirit and scope of the invention can be formed by enlarging the diameter of the top-turns of inner wire coil 26, thus forming the general equivalent of the above-described metal disk 27 or metal disk 100.

While the invention has been described in detail while making reference to embodiments thereof, it is known that others will, upon learning of the invention, readily visualize yet other embodiments that are within the spirit and scope of the invention. Thus this detailed description is not to be taken as a limitation on the spirit and scope of the invention.

What is claimed is:

1. An antenna, comprising:

a metal connector establishing an axis of said antenna;

said connector having a generally planar metal surface that extends generally perpendicular to said axis;

a hollow insulating tube having a first end located on said planar metal surface of said connector, having a second end spaced from said planar metal surface of said connector, having an outer surface that is generally concentric with said axis, and having an inner surface that is generally concentric with said axis, a large diameter coil of metal wire located adjacent to said outer surface of said insulating tube, and having one end thereof electrically engaging said planar metal surface of said connector;

a small diameter coil of metal wire located adjacent to said inner surface of said insulating tube;

said small diameter coil having a first and a second end;

said first end of said small diameter coil electrically engaging said planar metal surface of said connector; and a metal disk mounted on and electrically engaging said second end of said small diameter coil.

2. The antenna of claim 1 wherein said metal disk occupies a plane that extends generally perpendicular to said axis.

3. The antenna of claim 2 wherein said large diameter coil is responsive to at least a first frequency band, and wherein said small diameter coil and said disk form an assembly that is responsive to at least a second frequency band.

4. The antenna of claim 3 wherein said at least a first frequency band is a low frequency band and wherein said at least a second frequency band is a high frequency band.

5. The antenna of claim 4 wherein said small diameter coil is selected from a group consisting of a three-dimensional coil and a two-dimensional coil.

6. The antenna of claim 5, including:

a base member for said antenna including said metal connector;

said base member being selected from the group snap-in base member and screw-in base member.

7. An antenna, comprising:

a metal connector establishing an axis of said antenna;

said connector having a generally planar metal surface that extends generally perpendicular to said axis;

a hollow insulating tube having a first end located on said planar metal surface of said connector, having a second end spaced a given dimension from said planar metal surface of said connector, having an outer surface that is generally concentric with said axis, and having an inner surface that is generally concentric with said axis, a large diameter coil of metal wire located adjacent to said outer surface of said insulating tube, and having one end thereof electrically engaging said planar metal surface of said connector;

a small diameter coil of metal wire located adjacent to said inner surface of said insulating tube;

said small diameter coil having a first and a second end;

said first end of said small diameter coil electrically engaging said planar metal surface of said connector;

an axial length of said large diameter coil being greater than said given dimension of said insulating tube, and an axial length of said small diameter coil being greater that said given dimension of said insulating tube;

a sheath of dielectric material having a cup-shaped inner surface;

said sheath being mounted/molded on said antenna in a manner to cause said cup-shaped inner surface to physically engage and compress said axial length of said large diameter coil, and to physically engage and compress said axial length of said small diameter coil; and a metal disk associated with said second end of said small diameter coil;

wherein said cup-shaped inner surface of said sheath additionally physically engages said disk and forces said disk into engagement with said second end of said spacer tube as said sheath compresses said axial length of said small diameter coil.

8. The antenna of claim 7 wherein said disk occupies a plane that extends generally perpendicular to said axis.

9. The antenna of claim 8 wherein said small diameter coil is selected from a group consisting of a three-dimensional coil and a two-dimensional coil.

10. The antenna of claim 9, including:

a base member for said antenna that includes said metal connector;

said base member being selected from the group snap-in base member and screw-in base member.

11. An antenna, comprising:

a metal connector establishing an axis of said antenna;

said connector having a generally planar metal surface that extends generally perpendicular to said axis;

a hollow insulating tube having a first end located on said planar metal surface of said connector, having a second end spaced a given distance from said planar metal surface of said connector, having an outer surface that is generally concentric with said axis, and having an inner surface that is generally concentric with said axis, a large diameter coil of metal wire located adjacent to said outer surface of said insulating tube, and having one end thereof electrically engaging said planar metal surface of said connector;

a small diameter coil of metal wire located adjacent to said inner surface of said insulating tube;

said small diameter coil having a first and a second end;

said first end of said small diameter coil electrically engaging said planar metal surface of said connector;

said outer surface of said hollow insulating tube including a spiral groove into which turns of said large diameter coil are placed;

an axial length of said small diameter coil being greater that said given distance;

a sheath of dielectric material covering said antenna and operating to compress said axial length of said small diameter coil to be generally equal to said given distance; and a metal disk electrically connected to said second end of said small diameter coil;

wherein said sheath additionally forces said disk into engagement with said second end of said spacer tube as said sheath compresses said axial length of said small diameter coil.

12. The antenna of claim 11 wherein said small diameter coil is selected from a group consisting of a three-dimensional coil and a two-dimensional coil.

13. The antenna of claim 12, including:

a base member for said antenna including said metal connector;

said base member being selected from the group snap-in base member and screw-in base member.

14. The antenna of claim 13 wherein said metal disk occupies a plane that extends generally perpendicular to said axis.

15. The antenna of claim 14 wherein said large diameter coil is responsive to at least a first frequency band, and wherein said small diameter coil is responsive to at least a second frequency band.

16. The antenna of claim 15 wherein said at least a first frequency band is a low frequency band and wherein said at least a second frequency band is a high frequency band.

17. The method of making an antenna that is responsive to at least a first and a second band of frequencies, comprising the steps of:

providing a metal connector having a metal surface;

providing a hollow insulating tube having an axis, having first end, having a second end that is spaced a given distance from said first end, having an outer surface that is generally concentric with said axis, and having an inner surface that is generally concentric with said axis;

mounting said first end of said hollow insulating tube on or generally adjacent to said metal surface of said connector;

providing a relatively large diameter coil that is responsive to at least a first frequency band;

placing said relatively large diameter coil generally adjacent to said outer surface of said hollow insulating tube with one end of said relatively large diameter coil electrically connected to said metal surface of said connector;

providing a relatively small diameter coil that is responsive to at least a second frequency band;

placing said relatively small diameter coil generally adjacent to said inner surface of said hollow insulating tube with one end of said relatively small diameter coil electrically connected to said metal surface of said connector;

selecting said relatively small diameter coil from a group consisting of a three-dimensional coil and a two-dimensional coil;

providing a metal disk, and mounted said disk on and electrically connected to an opposite end of said relatively small diameter coil.

18. The method of 17 wherein said disk occupies a plane that extends generally perpendicular to an axis of said relatively small diameter coil.

19. The method of claim 18, including the steps of:

providing a base member for said antenna that includes said metal connector; and selecting said base member a group consisting of a snap-in base member and screw-in base member.

20. A stubby antenna constructed and arranged to be responsive to at least one low frequency band and at least one high frequency band, comprising:

a metal connector having a generally flat metal surface;

a hollow and elongated insulating tube having an outer surface, having an inner surface, having a first end, and having a second end that engages said generally flat metal surface of said connector;

a relatively large diameter metal coil responsive to said at least one low frequency band coiled around said outer surface of said insulating tube with one end of said relatively large diameter coil electrically engaging said generally flat metal surface of said connector;

a relatively small diameter metal coil responsive to said at least one high frequency band adjacent said inner surface of said insulating tube with one end of said relatively small diameter coil electrically engaging said generally flat metal surface of said connector; and a metal disk mounted on and electrically engaging an opposite end of said relatively small diameter coil.

21. The antenna of claim 20 wherein said relatively large diameter coil and said relatively small diameter coil both have an axial length that is greater than an axial length of said insulating tube, the antenna including:

a sheath of dielectric material mounted or molded on said antenna in a manner to compress said axial lengths of said relatively large diameter coil and said relatively small diameter coil to be generally equal to said axial length of said insulating tube.

22. The antenna of claim 21 wherein said at least one low frequency band is a frequency band that extends from about 880 MHz to about 960 MHz, and wherein said at least one high frequency band is a frequency band that extends from about 1710 MHz to about 2170 MHz.

23. The antenna of claim 22 including:

a base member adapted to mount said antenna on a wireless communications device;

said base member being selected from a group consisting of a snap-in base member and a screw-in base member.

24. A method of making a double helix antenna having a single input/output, comprising the steps of:

providing an input/output connector having a generally flat metal surface;

providing a hollow insulating tube having an outer surface, an inner surface, a first end, and a second end;

supporting said first end of said insulating tube on said flat metal surface;

providing a relatively large diameter metal coil having a first and a second end;

placing said relatively large diameter and elongated metal coil to encircle said outer surface of said insulating tube, with said first end of said relatively large diameter metal coil generally adjacent to, and electrically engaging, said flat metal surface;

providing a relatively small diameter and elongated metal coil having a first and a second end;

placing said relatively small diameter metal coil generally adjacent to said inner surface of said insulating tube, with said first end of said relatively small diameter metal coil generally adjacent to, and electrically engaging, said flat metal surface;

providing a generally flat metal disk;

placing said flat metal disk generally adjacent to, and electrically connected to; said second end of said relatively small diameter metal coil;

providing a generally cup-shaped sheath of dielectric material; and placing said generally cup-shaped sheath over said insulating tube in a manner to physically engage said flat metal disk and said second end of said relatively large diameter metal coil, to thereby compress said relatively large diameter metal coil and said relatively small diameter metal coil against said flat metal surface, and to thereby provide an outer cover for said antenna.

* * * * *